US006138965A

United States Patent [19]

Iorio et al.

[11] Patent Number: 6,138,965

[45] Date of Patent: Oct. 31, 2000

[54] COLLAPSIBLE HOOP STAND

[76] Inventors: Jennifer Iorio; Robert Iorio, both of 10306 NW. 48th Ct., Coral Springs, Fla. 33076

[21] Appl. No.: 09/252,810

[22] Filed: Feb. 19, 1999

[51] Int. Cl.[7] ..... A47G 23/02

[52] U.S. Cl. ..... 248/150; 248/148; 248/95; 38/102.2; D3/26

[58] Field of Search ..... 248/150, 146, 248/151, 154, 148, 396, 163.1, 95, 99, 126, 121, 97; 269/303; D3/26; 38/102.2

[56] References Cited

U.S. PATENT DOCUMENTS

| | | | |
|---|---|---|---|
| 130,051 | 7/1872 | Hollidge | 248/97 |
| D. 244,755 | 6/1977 | Bard | D15/66 |
| D. 260,475 | 9/1981 | Hall | D34/6 |
| D. 284,044 | 6/1986 | Di Martino | D3/26 |
| D. 309,058 | 7/1990 | Peters | D3/26 |
| D. 357,799 | 5/1995 | Wilkerson | D3/26 |
| 0,396,073 | 1/1889 | Cory | 38/102.2 |
| 0,437,240 | 9/1890 | Przewdzink | 38/102.2 |
| 744,070 | 11/1903 | Harmes | 38/102.2 |
| 1,356,142 | 10/1920 | Harris, Jr. | 248/97 |
| 1,548,681 | 8/1925 | Grimes | 248/148 |
| 1,700,666 | 1/1929 | Bright | 38/102.2 |
| 3,309,803 | 3/1967 | Wilson | 38/102.2 |
| 3,614,041 | 10/1971 | Koger | 248/97 |
| 3,818,620 | 6/1974 | Field et al. | 38/102.2 |
| 4,157,801 | 6/1979 | Elmer | 248/97 |
| 4,494,344 | 1/1985 | Petcen | 38/102.2 |
| 4,590,695 | 5/1986 | McGillivray | 38/102.2 |
| 4,767,111 | 8/1988 | Guenther | 269/303 |
| 4,827,638 | 5/1989 | Peters | 38/102.2 |
| 5,027,989 | 7/1991 | Nevius | 223/120 |
| 5,211,362 | 5/1993 | Householder | 248/124.1 |
| 5,327,665 | 7/1994 | Manning et al. | 38/102.2 |

*Primary Examiner*—Anita M. King
*Attorney, Agent, or Firm*—Tom Hamill, Jr.

[57] ABSTRACT

A collapsible hoop stand is provided. The stand includes a generally circular ring or hoop shaped base portion having a first diameter and a generally circular ring or hoop shaped upper portion having a first diameter. The base portion is connected to the upper portion by three leg members. The leg members are each connected at their upper and lower ends to the upper portion and the base portion respectively. The connection is designed to be removable, permitting the portable stand to be easily assembled, disassembled, and stored. Two of the leg members are of a first length and the third member is of a second length. The leg member second length is less than the two leg member's first length, and includes a bend, causing the upper portion to be angled. A second generally circular ring or hoop shaped upper portion is also provided. The second upper portion has a second diameter which is greater than the first upper portion's first diameter. The second upper portion is designed to fit atop the first upper portion with a piece of fabric being secured intermediate the second upper portion and the first upper portion. This permits the user to perform needlework at any location in an efficient and ergonomic manner.

16 Claims, 5 Drawing Sheets

COLLAPSIBLE HOOP STAND

BACKGROUND OF THE INVENTION

1. Field of the Invention

The present invention relates generally to work holder devices to aid in stitching, quilting, embroidery and the like, and more particularly, to a collapsible hoop device, especially adapted to effect a angled work platform for the user.

2. Description of the Prior Art

Adjustable hoop style stands are found in the art. Additionally, stands which place the work at an angle to the user are also known in the art. Such a reference is U.S. Pat. No. 3,309,803 issued to Wilson. Wilson discloses an embroidery holder wherein an embroidery hoop may be adjusted to a plurality of angles by rotating the hoop about a pivoting section which is connected to the base. The Wilson device, however, includes only a single leg and is of generally more complex of a mechanical arrangement than the instant invention.

Another device is shown in U.S. Pat. No. 1,700,666 issued to Bright. The Bright device includes two legs which attach from a base portion to an upper portion in such a manner to place the upper portion into an angled relation to the user. The Bright device only includes two legs of equal length and has hoops of different structure than the instant invention.

Additionally, other art is known and has been provided to the United States Patent and Trademark Office.

The foregoing body of prior art indicates it to be well known to employ hoop stands which are adjustable and place the work at an angle to the user, the provision of a simple three legged device which places the work at an angle to the user has not been contemplated. Nor does the prior art described above teach or suggest a hoop stand device which may be assembled or disassembled with ease, for storage, transport and use in any location. Other advantages of the present invention over the prior art also will be rendered evident.

SUMMARY OF THE INVENTION

The collapsible hoop stand is to be employed to achieve hand free sewing and quilting. It may be used to travel with, or used anywhere, because it rests on the user's lap enabling them to sew or quilt in a hand's free manner. The upper hoop portion being angled increases visibility for various stitching functions such as cross-stitch, crewel work, ribbon embroidery, bead work embellishments, embroidery, couching, needlepoint and quilting.

The present invention provides a collapsible hoop stand. The stand includes a generally circular ring or hoop shaped base portion having a first diameter and a generally circular ring or hoop shaped upper portion having the same first diameter. The base portion is connected to the upper portion by three leg members. The leg members are each connected at their upper and lower ends to the upper portion and the base portion respectively. The connection is designed to be removable, permitting the portable stand to be easily assembled, disassembled, and stored. Two of the leg members are of a first length and the third member is of a second length. The leg member second length is less than the two leg member's first length, and includes a bend, causing the upper portion to be angled. A second generally circular ring or hoop shaped upper portion is also provided. The second upper portion has a second diameter which is greater than the first upper portion's first diameter. The second upper portion is designed to fit atop the first upper portion with a piece of fabric being secured intermediate the second upper portion and the first upper portion. This permits the user to perform needlework at any location in an efficient and ergonomic manner.

The stand may be manufactured from plastics, rubbers, woods or metals. The removable connection may be mechanical fasteners, preferably screws and nuts. The nuts may be wing nuts to facilitate ease of removal and tightening.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

An object of the invention is to provide a collapsible hoop stand in a variety of sizes to accommodate sewers, quilters and other similar applications.

An object of the invention is to provide a collapsible hoop stand which includes an upper and lower hoop, the lower hoop forming the base.

Another object of the invention is to provide a collapsible hoop stand wherein the upper hoop is connected to the lower hoop by three leg members.

Another object of the invention is to provide a collapsible hoop stand wherein two of the legs are of a first length, and the third leg is of a second length, and further wherein the first length is greater than the second length.

Another object of the invention is to provide a collapsible hoop stand wherein the first length as mentioned immediately above, is less than the second length.

Still another object of the invention is to provide a collapsible hoop stand wherein the three legs are attached to both the upper and lower hoops by removable fasteners, permitting the stand to be easily assembled and disassembled.

Still another object of the invention is to provide a collapsible hoop stand including a second upper hoop which fits atop the upper hoop, holding a piece of fabric intermediate the upper hoop and the second upper hoop in a taught fashion, permitting to be performed upon the fabric.

It is another object of the invention to provide a collapsible hoop stand which may be easily and efficiently manufactured and marketed.

It is a further objective of the invention to provide a collapsible hoop stand which is of durable and reliable construction.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a portable hoop stand embodying the principles and concepts of the present invention will be described.

Figure 1:
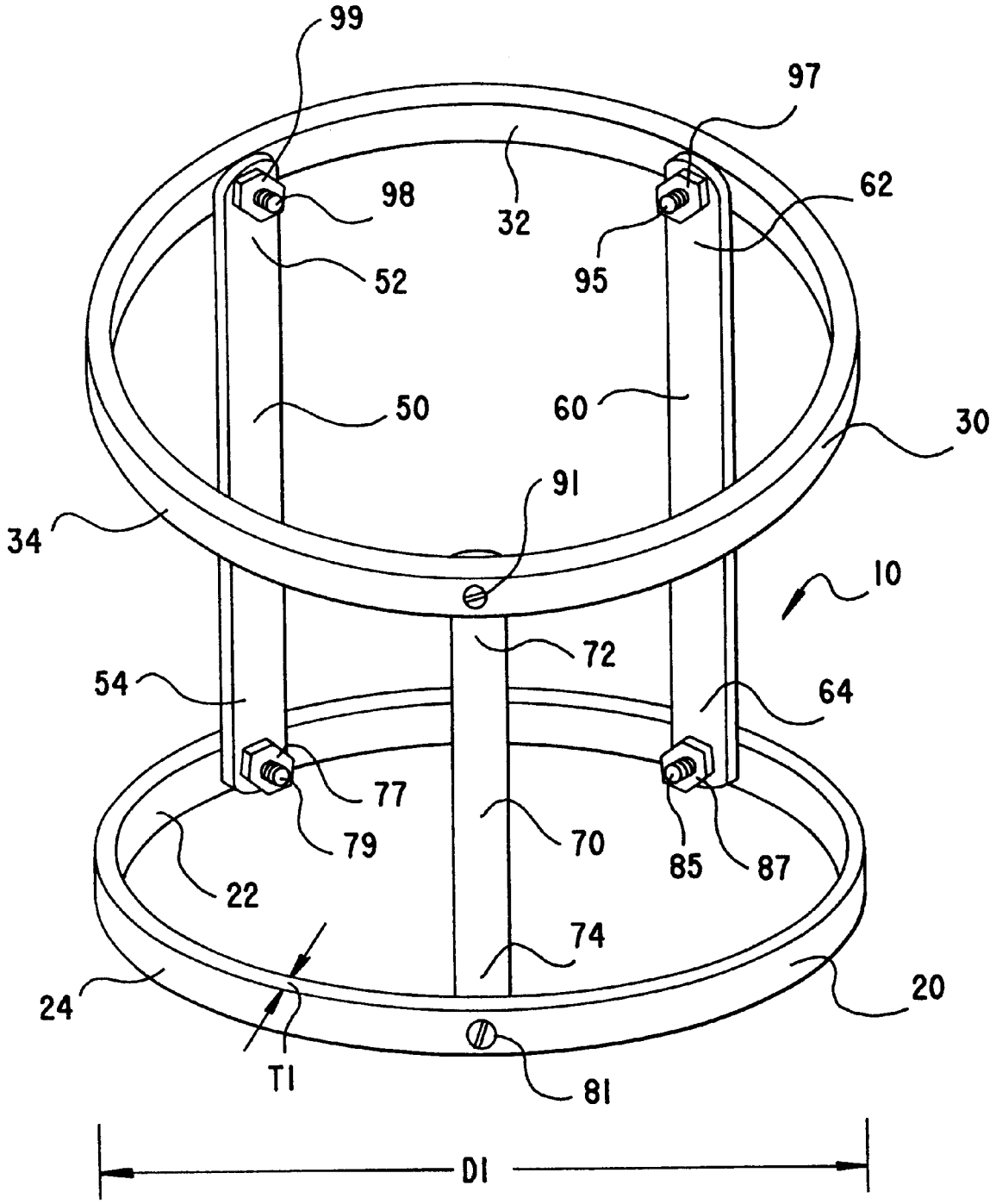
FIG. 1 is a view showing the collapsible hoop stand body portion.

Referring to FIG. 1, there is shown a collapsible hoop stand body generally designated by reference numeral 10.

In its preferred form, the hoop stand body 10 comprises generally a circular ring or hoop shaped base portion 20 having a first diameter D1. The base portion has an interior surface 22, an exterior surface 24 and a thickness t1. The base portion 20 is connected to a circular ring or hoop shaped upper portion 30 which also has a first diameter D1. The upper portion has an interior surface 32, an exterior surface 34 and a thickness T1.

Figure 2:
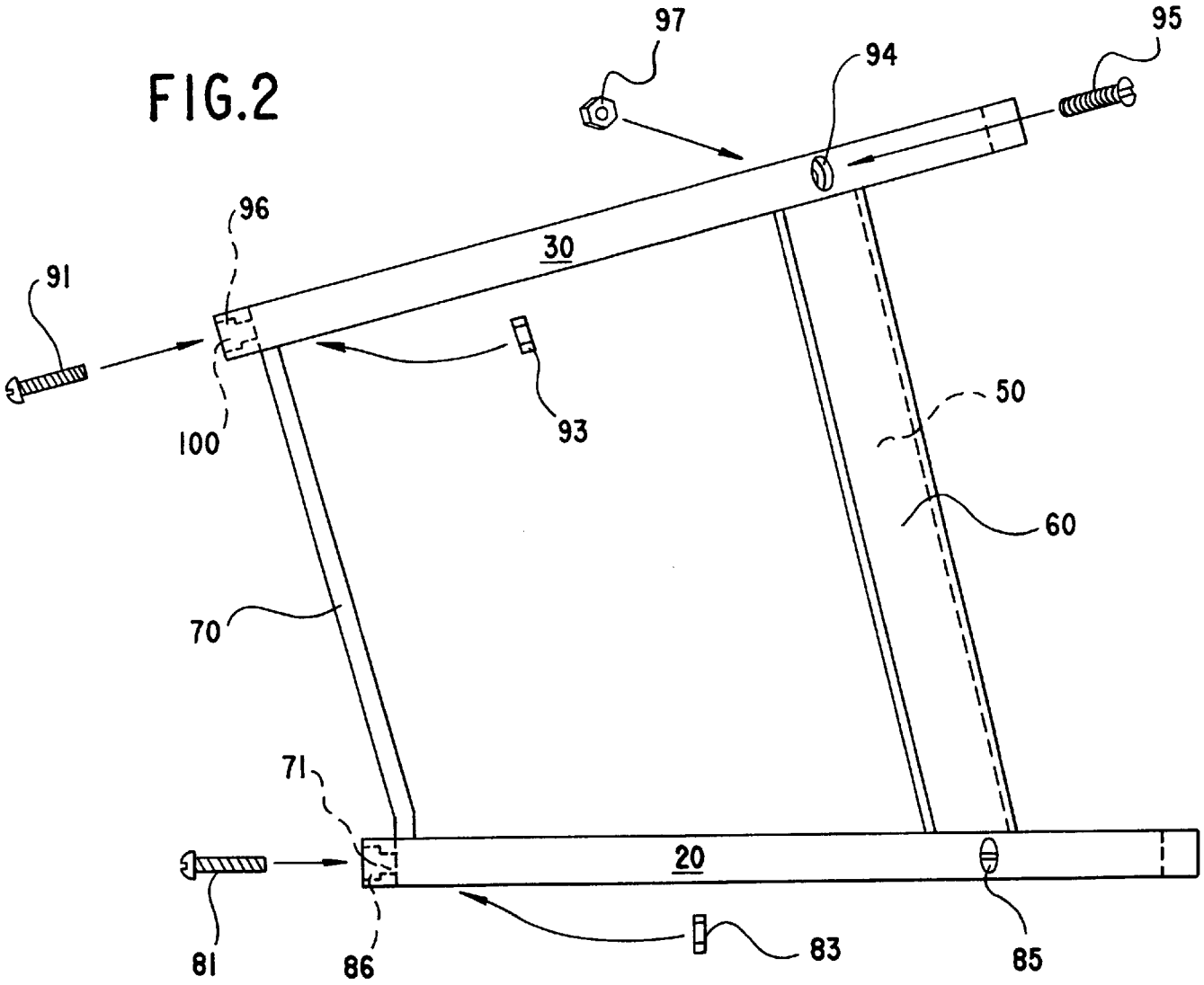
FIG. 2 is a side view showing the collapsible hoop stand body portion.
Figure 10:
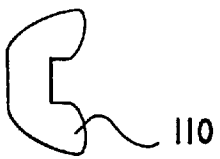
FIG. 10 is a view of a wing nut.
Figure 7:
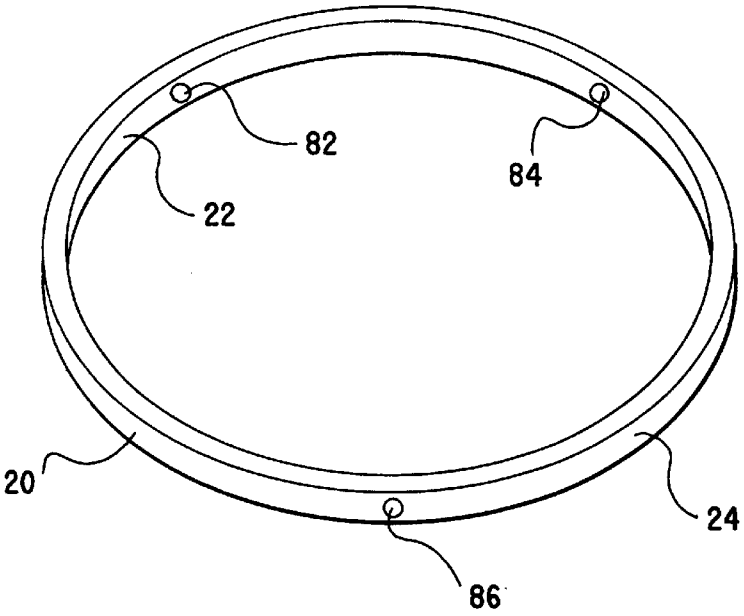
FIG. 7 is a view of the base portion of the collapsible hoop stand.

As best seen in FIG. 7 the base portion 20 includes a first aperture 82, a second aperture 84, and a third aperture 86, penetrating from the interior surface 22 to the exterior surface 24. The first aperture 82, second aperture 84 and third aperture 86 are equidistant and oriented generally radially. Being equidistant permits about 120 degrees of arc to separate the first aperture 82 from the second aperture 84, the second aperture 84 from the third aperture 86, and the third aperture 86 from the first aperture 82. The base portion's 20 first aperture 82, second aperture 84 and third aperture 86 are chosen to be countersunk in the fashion as generally represented in FIG. 2, element 71.

Figure 8:
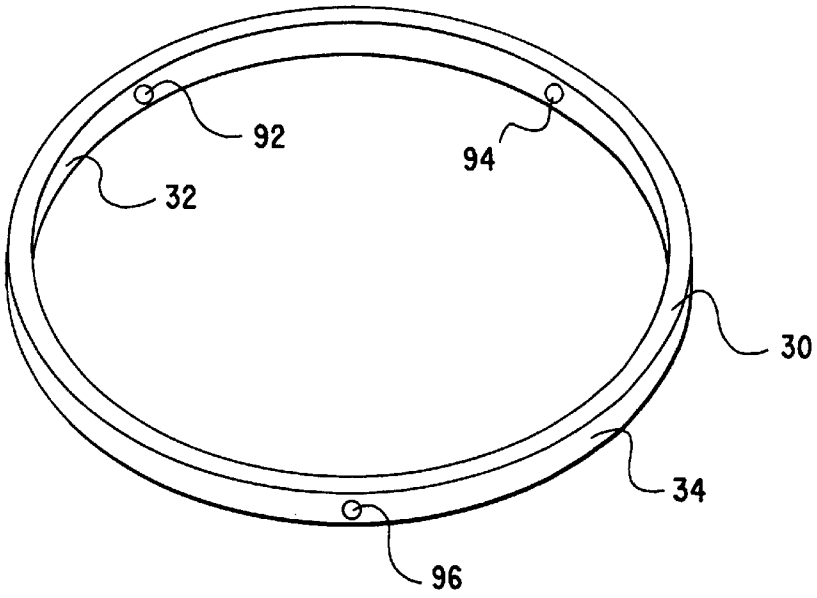
FIG. 8 is a view of the upper portion of the collapsible hoop stand.

As best shown in FIG. 8, the upper portion 30 also includes a first aperture 92, a second aperture 94 and a third aperture 96, penetrating from the interior surface 32 to the exterior surface 34. The upper portion's first aperture 92, second aperture 94 and third aperture 96 are equidistant and oriented generally radially. Being equidistant permits about 120 degrees of arc to separate the first aperture 92 from the second aperture 94, the second aperture 94 from the third aperture 96, and the third aperture 96 from the first aperture 92 on the upper portion 30. The upper portion's 30 first aperture 92, second aperture 94 and third aperture 96 are chosen to be countersunk in the fashion as generally represented in FIG. 2, element 100.

The connection between the base portion 20 and the upper portion 30 is accomplished by a first leg 50, a second leg 60 and a third leg 70.

Figure 3:
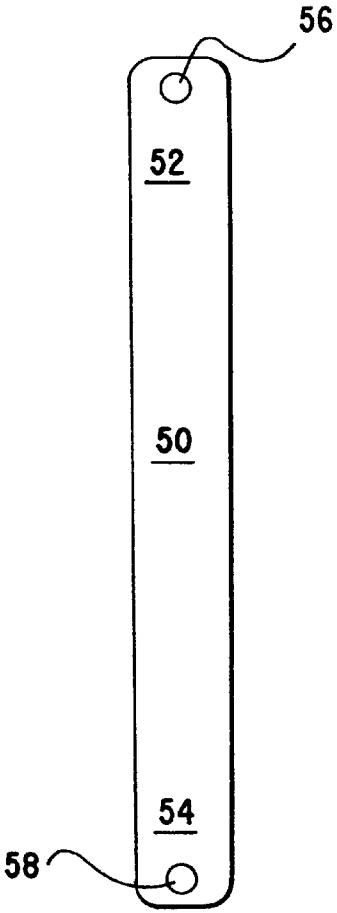
FIG. 3 is a view showing the first leg of the collapsible hoop stand.

Referring to FIG. 3, the first leg 50 has an upper portion 52 and a lower portion 54. The first leg 50 includes a first aperture 56 proximal the upper portion 52. The first leg 50 further includes a second aperture 58 proximal the lower portion 54. The first leg 50 upper portion 52 terminus and lower portion 54 terminus may be rounded, rectangular or another geometric configuration.

Figure 4:
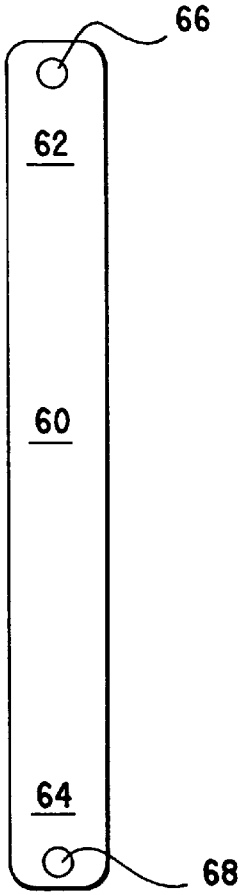
FIG. 4 is a view showing the second leg of the collapsible hoop stand.

Referring to FIG. 4, the second leg 60 has an upper portion 62 and a lower portion 64. The second leg 60 includes a first aperture 66 proximal the upper portion 62. The second leg 60 further includes a second aperture 68 proximal the lower portion 64. The second leg 60 upper portion 62 terminus and lower portion 64 terminus may be rounded, rectangular or another geometric configuration.

Figure 6:
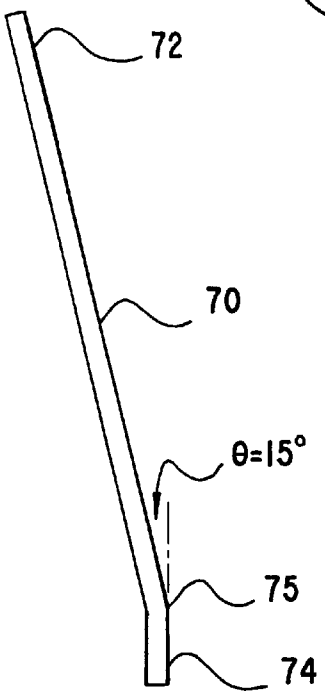
FIG. 6 is a side view of the third, shorter leg of the collapsible hoop stand.
Figure 5:
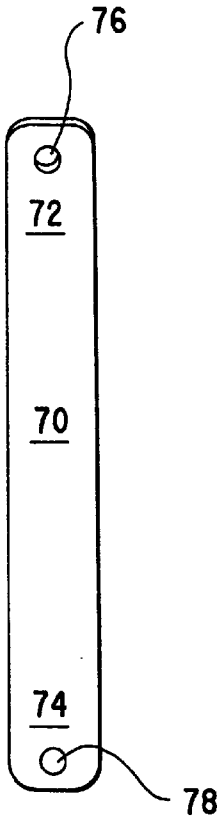
FIG. 5 is a view showing the third, shorter leg of the collapsible hoop stand.

Referring to FIGS. 5 and 6, the third leg 70 has an upper portion 72 and a lower portion 74. The third leg 70 includes a first aperture 76 proximal the upper portion 72. The third leg 70 further includes a second aperture 78 proximal the lower portion 74. The third leg 70 further includes a bend 75 which is also proximal the lower portion 74, yet lies above the third leg second aperture 78. The bend 75 may be an angle about 15 degrees, however, may be in the range of 0 degrees to 90 degrees. It is to be appreciated the instant invention may be inverted, changing the angle of the bend 75. Also, in the case where the angle is chosen to be zero degrees, the third leg 70 would be straight. The third leg 70 upper portion 72 terminus and lower portion 74 terminus may be rounded, rectangular or another geometric configuration.

As best seen in FIGS. 1 and 2, six mechanical fasteners are provided to secure the three legs intermediate the base portion 20 and the upper portion 30. It is to be understood that any of a plurality of types of mechanical fasteners may be employed to secure the legs, and as such are contemplated as being considered here.

The first mechanical fastener 79 would secure the first leg 50 to the interior surface 22 of the base portion 20 by passing the first fastener 79 through the base portion's first aperture 82 and the first leg's first aperture 58 and having a first nut 77 secure the first fastener 79 thereto.

The second mechanical fastener 85 would secure the second leg 60 to the interior surface 22 of the base portion 20 by passing the second fastener 85 through the base portion's second aperture 84 and the second leg's first aperture 68 and having a second nut 87 secure the second fastener 85 thereto.

The third mechanical fastener 81 would secure the third leg 70 to the interior surface 22 of the base portion 20 by passing the third fastener 81 through the base portion's third aperture 86 and the third leg's first aperture 78 and having a third nut 83 secure the third fastener 81 thereto.

The fourth mechanical fastener 98 would secure the first leg 50 to the interior surface 32 of the upper portion 30 by passing the fourth fastener 98 through the upper portion's first aperture 92 and the first leg's second aperture 56 and having a fourth nut 99 secure the fourth fastener 98 thereto.

The fifth mechanical fastener 95 would secure the second leg 60 to the interior surface 32 of the upper portion 30 by passing the fifth fastener 95 through the upper portion's second aperture 94 and the second leg's second aperture 66 and having a fifth nut 97 secure the fifth fastener 95 thereto.

The sixth mechanical fastener 91 would secure the third leg 70 to the interior surface 32 of the upper portion 30 by passing the sixth fastener 91 through the upper portion's third aperture 96 and the third leg's second aperture 76 and having a sixth nut 93 secure the sixth fastener 91 thereto.

It is to be understood that the first, second and third legs may be affixed to the exterior surface 24 of the base portion 20 and the exterior surface 34 of the upper portion 30 as well.

Additionally, other types of fasteners may be employed. It has been considered that wing nuts 110 permits a greater ease of assembly and disassembly.

Figure 9:
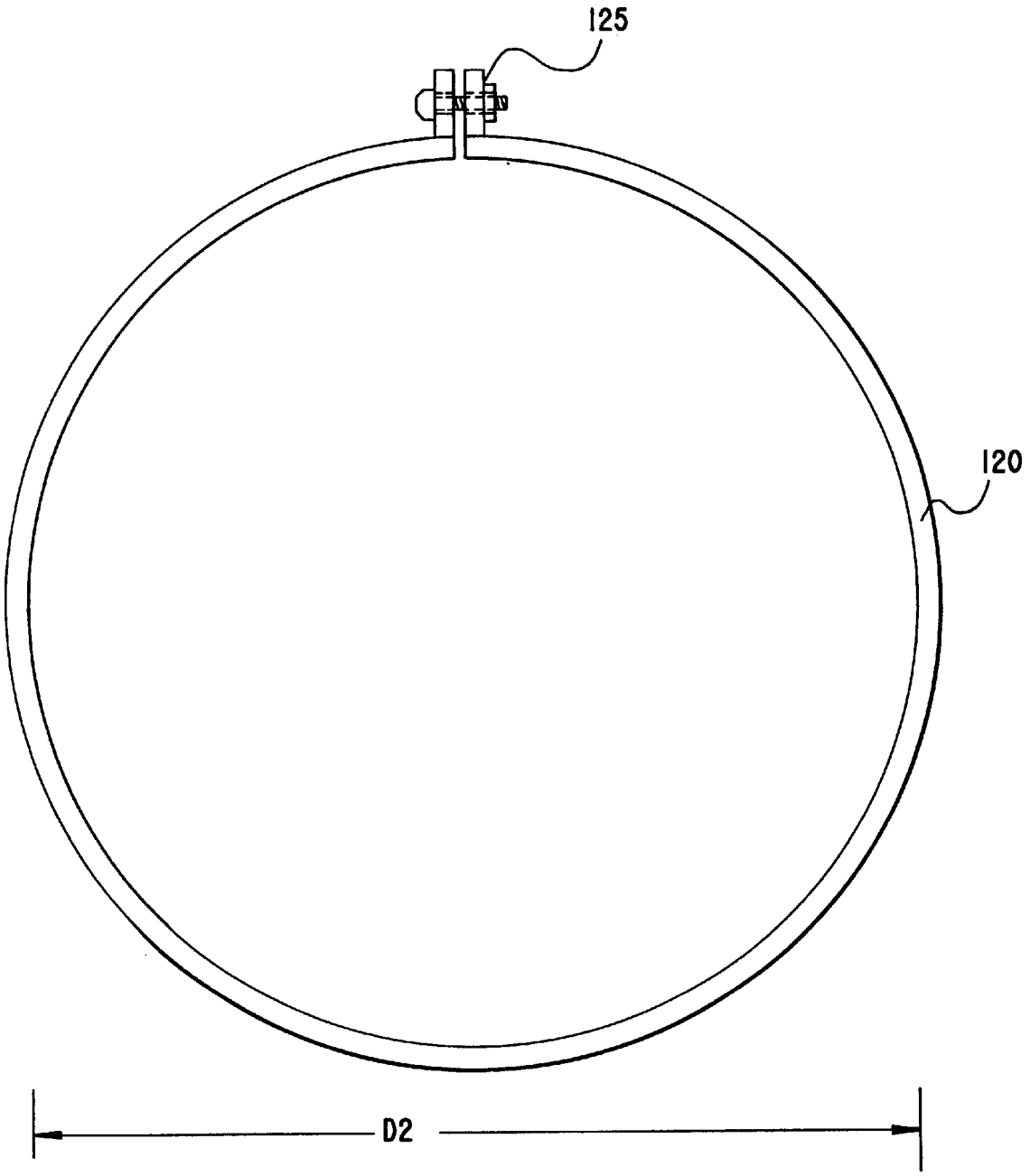
FIG. 9 is a view of the upper most hoop of the collapsible hoop stand which would fit atop the body portion.

Referring now specifically to FIG. 9, a second upper ring portion 120 is shown. The second upper portion 120 has a second diameter d2. The second diameter d2 of the second upper portion 120 is sufficiently larger than the first diameter D1 of the upper portion 30 to permit the second upper portion 120 to fit atop the upper portion 30 with a piece of fabric work disposed therebetween. The fabric work is designed to have needlework performed upon it. Additionally, the second upper portion 120 has a tightening means 125 which permits the second upper portion 120 to be tightened in order to firmly secure the fabric work in between the second upper portion 120 and the upper portion 30.

It is apparent from the above that the present invention accomplishes all of the objectives set forth by providing a collapsible hoop stand which renders the work surface in an angled relation to the user. The hoop stand may come in a variety of sizes to accommodate different types of needlework.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed is:

1. A collapsible hoop stand comprising, a base portion, said base portion having a ring shape and having a first diameter, a first upper portion, said first upper portion having a ring shape and having said first diameter, a first leg member, a second leg member, and a third leg member are affixed to said upper portion and to said base portion by removable affixing means, wherein said first leg member and said second leg member are of a first length, and said third leg member is of a second length, said second length being less than said first length, causing said upper portion to be angled, said first leg member, said second leg member and said third leg member not extending below said base portion, a second upper portion, said second upper portion having a ring shape and having a second diameter, said second diameter being larger than said first diameter, whereby, a piece of fabric to have needlework performed upon is placed over said first upper portion, and said second upper portion is placed atop said fabric and said first upper portion, securing said fabric in place, said fabric being in an angled orientation toward the user.

2. A collapsible hoop stand as claimed in claim 1, wherein said first leg has a first aperture proximal an upper end and a second aperture proximal a lower end, and said second leg has a first aperture proximal an upper end and a second aperture proximal a lower end, and said third leg has a first aperture proximal an upper end and a second aperture proximal a lower end.

3. A collapsible hoop stand as claimed in claim 2, wherein said base portion has a first aperture, a second aperture and a third aperture, said first aperture, said second aperture, and said third aperture are each separated by 120 degrees of arc.

4. A collapsible hoop stand as claimed in claim 3, wherein said first upper portion has a first aperture, a second aperture and a third aperture, said first aperture, said second aperture and said third aperture are each separated be 120 degrees of arc.

5. A collapsible hoop stand as claimed in claim 4 wherein;

a) a first screw passes through said lower base portion first aperture and said first leg second aperture, wherein said first screw is removably and securely mated with a first nut, b) a second screw passes through said lower portion second aperture and said second leg second aperture, wherein said second screw is removably and securely mated with a second nut, c) a third screw passes through said lower portion third aperture and said third leg second aperture, wherein said third screw is removably and securely mated with a third nut, d) a fourth screw passes through said first upper portion first aperture and said first leg upper first end aperture, wherein said fourth screw is removably and securely mated with a fourth nut, e) a fifth screw passes through said first upper portion second aperture and said second leg first aperture, wherein said fifth screw is removably and securely mated with a fifth nut, f) a sixth screw passes through said first upper portion third aperture and said third leg first aperture, wherein said sixth screw is removably and securely mated with a sixth nut.

6. A collapsible hoop stand as claimed in claim 5 wherein said first upper portion first aperture, second aperture and third aperture are countersunk.

7. A collapsible hoop stand as claimed in claim 6 wherein said base portion's first aperture, second aperture and third aperture are all countersunk.

8. A collapsible hoop stand as claimed in claim 7 wherein said first leg upper end and said first leg lower end are generally rectangular.

9. A collapsible hoop stand as claimed in claim 7 wherein said first leg upper end and said first leg lower end are generally rounded.

10. A collapsible hoop stand as claimed in claim 9 wherein said second leg upper end and said first leg lower end are generally rectangular.

11. A collapsible hoop stand as claimed in claim 9 wherein said second leg upper end and said first leg lower end are generally rounded.

12. A collapsible hoop stand as claimed in claim 11 wherein said third leg upper end and said third leg lower end are generally rectangular.

13. A collapsible hoop stand as claimed in claim 11 wherein said third leg upper end and said third leg lower end are generally rounded.

14. A collapsible hoop stand as claimed in claim 13 wherein said first nut, said second nut, said third nut, said fourth nut, said fifth nut, and said sixth nut are chosen to be wingnuts.

15. A collapsible hoop stand as claimed in claim 1 wherein said third leg is includes a bend proximal a lower end.

16. A collapsible hoop stand as claimed in claim 15 wherein said bend causes an upper end to have about 0–90 degree angle from the vertical.

* * * * *